US010873817B2

(12) United States Patent
Aschoff et al.

(10) Patent No.: US 10,873,817 B2
(45) Date of Patent: Dec. 22, 2020

(54) METHOD FOR REDUCING THE OCCURRENCE OF ACOUSTIC FEEDBACK IN A HEARING DEVICE AND HEARING DEVICE

(71) Applicant: SIVANTOS PTE. LTD., Singapore (SG)

(72) Inventors: Stefan Aschoff, Eckental (DE); Stefan Petrausch, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/418,035

(22) Filed: May 21, 2019

(65) Prior Publication Data

US 2019/0373379 A1 Dec. 5, 2019

(30) Foreign Application Priority Data

May 30, 2018 (DE) ..... 10 2018 208 657

(51) Int. Cl.
*H04R 25/00* (2006.01)
*G10K 11/178* (2006.01)
*G10L 21/0232* (2013.01)

(52) U.S. Cl.
CPC ..... *H04R 25/453* (2013.01); *G10K 11/1783* (2018.01); *G10K 11/17813* (2018.01); *G10K 11/17819* (2018.01); *G10L 21/0232* (2013.01); *H04R 25/505* (2013.01);
(Continued)

(58) Field of Classification Search
CPC .... H04R 25/305; H04R 25/45; H04R 25/453; H04R 25/505; H04R 2225/41; H04R 3/02; H04R 2460/01; G10K 11/17813; G10K 11/17819; G10K 11/1783; G10L 21/0232
USPC ..... 381/60, 318, 320, 71.6, 94.2, 94.3; 700/94
See application file for complete search history.

(56) References Cited

U.S. PATENT DOCUMENTS 8,355,517 B1 * 1/2013 Fretz ..... H04R 25/453 381/317
8,452,035 B2 5/2013 Arndt et al.
9,227,057 B2 * 1/2016 McElveen, Jr. .... A61N 1/37264
(Continued)

FOREIGN PATENT DOCUMENTS

DE 102010011729 A1 9/2011
EP 2869600 A1 5/2015
EP 2908549 A1 8/2015

*Primary Examiner* — Jesse A Elbin
(74) *Attorney, Agent, or Firm* — Laurence A. Greenberg; Werner H. Stemer; Ralph E. Locher

(57) ABSTRACT

In a method that reduces the occurrence of acoustic feedback in a hearing device, a first wearing situation is created that determines a positioning of the hearing device relative to the wearer. For the first wearing situation, a first usage situation is created being a body movement of the wearer of the hearing device and/or a relative position of an external object relative to the body of the wearer. A first number of frequency-resolved curves of a feedback tendency of the hearing device are determined for the first use situation. A first criticality measure is ascertained based on the frequency-resolved curve for the first use situation that contains information on a frequency range that is critical with respect to an occurrence of acoustic feedback and a corresponding relative probability of acoustic feedback, and a target is established for adapting a hearing device parameter based on the first criticality measure.

11 Claims, 3 Drawing Sheets

(52) U.S. Cl.
CPC ..... *H04R 25/305* (2013.01); *H04R 2225/41* (2013.01); *H04R 2460/01* (2013.01)

(56) References Cited

U.S. PATENT DOCUMENTS

| | | | | |
|---|---|---|---|---|
| 9,596,551 | B2 | 3/2017 | Pedersen et al. | |
| 9,729,976 | B2 * | 8/2017 | Natarajan | H04R 25/453 |
| 2007/0019824 | A1 * | 1/2007 | Osmanovic | H04R 3/02 381/93 |
| 2010/0202641 | A1 * | 8/2010 | Guo | H04R 25/453 381/318 |
| 2010/0260365 | A1 | 10/2010 | Petrausch | |
| 2013/0322668 | A1 | 12/2013 | Zhang et al. | |
| 2014/0275732 | A1 * | 9/2014 | Hillbratt | H04R 25/70 600/25 |
| 2015/0003652 | A1 | 1/2015 | Bisgaard et al. | |
| 2016/0057548 | A1 * | 2/2016 | Wurzbacher | H04R 25/45 381/315 |
| 2017/0156009 | A9 | 6/2017 | Natarajan | |
| 2018/0359572 | A1 * | 12/2018 | Jensen | H04R 25/405 |

* cited by examiner

METHOD FOR REDUCING THE OCCURRENCE OF ACOUSTIC FEEDBACK IN A HEARING DEVICE AND HEARING DEVICE

CROSS-REFERENCE TO RELATED APPLICATION

This application claims the priority, under 35 U.S.C. § 119, of German application DE 10 2018 208 657.5, filed May 30, 2018; the prior application is herewith incorporated by reference in its entirety.

BACKGROUND OF THE INVENTION

Field of the Invention

The invention relates to a method for reducing the occurrence of acoustic feedback in a hearing device. A first wearing situation is created that determines a positioning of the hearing device relative to the wearer, a first use situation is established for the first wearing situation, and a target is established for adapting at least one hearing device parameter.

When operating a hearing device, the occurrence of acoustic feedback is particularly problematic. The sound that an output transducer of the hearing device generates, which is intended for the hearing system of the wearer of the hearing device, propagates partially to an input transducer of the hearing device, and thus returns to the signal processing of the hearing device, which amplifies the signal from the input transducer. If the attenuation factor by which the sound of the output transducer is attenuated on the sound path to the input transducer is lower than the gain factor of the signal processing, the system may become unstable due to the closed gain loop. This is audible as a whistling noise at the relevant frequencies, and accordingly leads to a considerable impairment of the wearer's ability to hear.

One common way of suppressing such acoustic feedback is to reduce the gain of the signal processing if feedback is registered. The gain reduction may be limited to those frequency ranges in which feedback occurs. This has the drawback, however, that the signal processing gain is no longer selected exclusively as a function of the wearer's individual hearing impairment, and thus an output sound signal that the output transducer generates is no longer optimally tuned to the wearer's audiological needs. It is also possible to suppress acoustic feedback using an adaptive filter by implementing an electrical feedback loop. But doing so may cause artifacts in the output sound signal due to electronically cancelling signal components.

Moreover, the occurrence of acoustic feedback is to a considerable extent tied to the specific use situation. Although in normal operation at a given frequency, for example, it is possible for no feedback to be expected due to the ratio of attenuation in the acoustic feedback path and gain in electronic signal processing, in the event of changes such as telephoning with a mobile telephone or wearing headgear may change the acoustic feedback path in a way that reduces attenuation and creates a critical feedback loop. Such a spontaneous occurrence of feedback often leads to an unpleasant whistling noise when the above-described actions are taken to suppress feedback.

SUMMARY OF THE INVENTION

The object of the invention is to set forth a method by which a spontaneous occurrence of feedback in certain situations may be reduced, with as little influence as possible on the output signals generated based on the input signals in accordance with the hearing device wearer's individual hearing impairment.

This problem is solved according to the invention by a method for reducing the occurrence of acoustic feedback in a hearing device. Initially, a first wearing situation is created that determines a positioning of the hearing device relative to the wearer. For the first wearing situation, a first usage situation is created that is characterized by at least one body movement of the wearer of the hearing device and/or at least one relative position of an external object relative to the body of the wearer. A first number of frequency-resolved curves of a feedback tendency of the hearing device are determined for the first use situation. Here it is envisioned that a first criticality measure is ascertained based on the or each frequency-resolved curve for the first use situation that contains information on a frequency range that is critical with respect to an occurrence of acoustic feedback and a corresponding relative probability of acoustic feedback, and that a target is established for adapting at least one hearing device parameter based on the first criticality measure. Configurations that are advantageous and in part inventive in their own right are the subject matter of the dependent claims and the following description.

Here, a "wearing situation" refers particularly to the totality of the circumstances under which the hearing device is locally affixed to the wearer and in particular any exchangeable acoustic coupling piece that may be present (such as an earpiece or "dome") assumes a specific position. To this extent, two wearing situations may differ with regard to the exact spatial position of the hearing device and/or the acoustic coupling piece, or may also be specified by the use of different acoustic coupling pieces. Here and below, a "use situation" in particular comprises how the wearer of the hearing device performs body movements during operation, in particular in a specifically given use situation, or moves himself relative to limiting objects like walls or windows in the wearing situation, so that the movements that occur in the use situation are in particular suitable for influencing an acoustic feedback path of the hearing device.

A "feedback tendency" of the hearing device, in particular, comprises a frequency-dependent parameter that may be used to determine a quantitative probability of acoustic feedback occurring at the relevant frequency. In particular, such a feedback tendency may be given by a ratio or a difference between an attenuation of the acoustic feedback path and a gain through signal processing in the hearing device. A frequency-resolved curve of a feedback tendency may be given by the respective values of the feedback tendency over the corresponding frequency spectrum, or by the values of the feedback tendency at a plurality of sampling points for the frequency that are selected at a sufficiently high frequency resolution.

In the case of a plurality of frequency-resolved curves, a first criticality measure that may be selected for the first use situation may in particular be a curve for which the signal processing gain in the hearing device is greatest, for the respective frequency band, compared to the acoustic feedback path attenuation. In particular, such a curve may be created from the maximum values of the individual curves at each frequency.

However, the first criticality measure may also be ascertained for a plurality of frequency-resolved feedback tendency curves by weighting the values of the different curves at a given frequency. In this case, the criticality measure shall preferably be calculated such that at a given frequency, for a high variance of feedback tendency values of the different curves, a higher value is produced for the first criticality measure for a high variance of feedback tendency values than in a situation with an identical maximum feedback tendency value for a lower variance. This takes into account the fact that in the first use situation, for a high variance of the values of the feedback tendency at a certain frequency, a further dispersion beyond the decimal value recorded in the measurement is expected, while a low variance of the values at a given frequency indicates a greater intrinsic stability of the system. In this sense, the maximum values of the feedback tendency and the variation over the different curves at a given frequency may be used to deduce the risk of feedback at the corresponding frequency for the first use situation. In this case, the relative probability of such feedback may be related in particular to other frequency ranges, i.e. the first criticality measure may make a statement that feedback is more likely for a first frequency than for a second frequency if the value of the first criticality measure at the first frequency is greater than its value at the second frequency.

Preferably, at least one hearing device parameter is adapted according to the target established based on the first criticality measure, and may in particular be adapted automatically. Alternatively, a hearing device acoustician may do the adapting according to the target manually. Preferably, in this case, the at least one hearing device parameter is adapted with the additional requirement that signal amplification and playback dynamics in the hearing device should be affected as little as possible. This may be done in particular by adapting the at least one hearing device parameter only for the frequency range for which, based on the first criticality measure, feedback appears to be sufficiently likely in the first use situation. The evaluation may be carried out by a threshold value comparison of the frequency-resolved first criticality measure over the entire spectrum.

By adapting the at least one hearing device parameter based on the first criticality measure, the probability of feedback occurring may thus be limitedly targeted to those frequency ranges in which a change in the existing hearing device parameters is necessary in order to avoid feedback; in this way, the adapting may be made "minimally invasive" with regard to the hearing device's playback characteristics. Previous methods for reducing or suppressing feedback, which are based on adapting hearing device parameters, usually check the occurrence of feedback on a frequency-band basis. The hearing device parameters for the signals involved are adapted with the shortest possible time delay for checking, because this adaptation takes place while the hearing device is in operation. This means that on the level of checking, only a limited number of frequency bands are available, because otherwise the filters used to divide an input signal into different frequency bands would cause excessively high latency. On the other hand, at the level of adaptation, the hearing device parameters are set on a frequency band basis, and as a result, for example, a reduction of a gain factor in a frequency band affects the playback for the entire frequency band, while there may be a critical probability that feedback will occur only for a narrow frequency interval within this frequency band, and thus adapting the gain only over this interval would be sufficient.

In addition, it is possible to check whether the probability of feedback for the first feedback situation may really be reduced through a corresponding adaptation of the at least one hearing device parameter, based on the first criticality measure and the above-described adaption. If no such reduction is possible, this may be interpreted as indicating a problem is related to the wearing situation of the hearing device, in the broadest sense, and additional steps may be taken accordingly.

Preferably, a plurality of frequency-resolved curves of a feedback tendency are determined for the first use situation, and at a given frequency, the first criticality measure for the first use situation is established based on a dispersion measure for the values of the feedback tendency at that frequency that respectively result from the plurality of frequency-resolved curves. In particular, the first use situation is maintained continuously, e.g. by maintaining and/or repeating a corresponding body movement. Specifically, this may be done in such a way that the body movement that characterizes the first use situation is repeated a plurality of times and a plurality of feedback tendency curves are determined. This may be done over a predetermined period of time, or until a predetermined number of measured values and/or curves for the feedback tendency have been determined with a sufficient measurement quality. For each frequency, the dispersion measure is then calculated, for example the variance of the values that the different curves have for the feedback tendency at this frequency, and the first criticality measure is established based on the ascertained variances for different frequencies.

By using a dispersion measure that provides information on how the values of the feedback tendency may differ relative to the first use situation at a given frequency, it is possible to identify those frequency ranges in the feedback tendency at the values ascertained in the present curves should be expected to be exceeded; accordingly, the at least one hearing device parameter may also be adapted if none of the ascertained feedback tendency values is directly critical for an occurrence of feedback at a given frequency. Thus, at a given frequency, the dispersion measure of the feedback tendency values may be regarded as an indicator of the stability of the feedback path in the first use situation. At a low value of the dispersion measure, it is assumed that the values in real operation of the hearing device in a playback of the first use situation only slightly exceed the value range ascertained for the given frequency, and as a result, adaptation of the at least one hearing device parameter may be further restricted, which has a positive effect on the playback characteristics of the hearing device.

Expediently, the attenuation of an acoustic feedback path may be measured, the feedback tendency at a given frequency being respectively determined based on signal amplification in the hearing device and the attenuation of the acoustic feedback path. In particular, at a given frequency, the feedback tendency is determined as a sum or product of the attenuation of the acoustic feedback path and the signal amplification in the hearing device. In this case, the attenuation of the acoustic feedback path may be determined in particular by means of an adaptive filter, or it may be measured directly by means of a modulated test signal.

It is advantageous for the first use situation to be created by the wearer wearing headgear, and/or making a jaw movement, and/or using a mobile telephone in the vicinity of the hearing device, and/or engaging in a sporting activity, and/or being positioned in the immediate vicinity of a spatial boundary. Headgear in particular comprises a hat, a cap, and a headscarf. In particular, jaw movement may consist of a chewing movement or speaking. "Spatial boundary" here comprises in particular a window and a wall. In this case, the positioning is not linked to movement; rather, in particular, it may also be based on a purely static situation in the vicinity of the boundary. In particular, the aforementioned conditions may be cumulatively present for the first use situation, e.g. when the wearer removes headgear for an initial telephone call. The possibilities mentioned for the first use situation cover a broad spectrum of situations that may occur in everyday life and in which an acoustic feedback path may in principle change.

In an advantageous configuration of the invention, the at least one hearing device parameter is selected from a total gain at a frequency, and/or a compression characteristic curve at a frequency, and/or a readjustment speed. Here, the compression characteristic curve at a frequency is defined in particular by a compression ratio and a knee point. In particular, the total gain at a frequency may also comprise a frequency interval immediately surrounding the frequency. If the first criticality measure is ascertained substantially continuously over the frequency, then critical frequencies with regard to the probability of acoustic feedback usually do not occur in isolation—because at such a frequency, the first criticality measure would have to assume its critical value exactly at the point of contact—but over an interval of frequencies. The total gain or the compression characteristic curve in this interval, or a readjustment speed of the adaptive filter may now be adapted as the at least one hearing device parameter. These hearing device parameters are, to begin with, suitable for suppressing acoustic feedback through appropriate adaptation. In addition, it is technically possible to adapt them in the hearing device without additional effort, so that no unnecessary strain on the signal processing is required.

Preferably, a second use situation is created for the first wearing situation, a second criticality measure is ascertained for the second use situation, and based on the second criticality measure, a target is established for adapting the at least one hearing device parameter and/or an additional hearing device parameter. In particular, the second criticality measure for the second use situation is ascertained in an analogous manner to the first criticality measure for the first use situation. This makes it possible to evaluate the likelihood of feedback for different processes individually, and to require one or more hearing device parameters to be adapted depending on the totality of the evaluations. Particularly preferably, the second use situation is created by one of the activities specified for the first use situation.

In another advantageous configuration, the at least one hearing device parameter is adapted in accordance with the target established based on the first criticality measure, the hearing device is operated in a test mode with the adapted hearing device parameter, with the first use situation being produced in the test mode, and a third criticality measure is ascertained for the first use situation in the test mode, in particular for automatically checking the adaptation. Preferably, the third criticality measure is ascertained in the manner described above, i.e. in particular analogously to the first criticality measure, which ensures that the values are comparable at a given frequency. In particular, the test mode may also consist of resuming regular operation of the hearing device, such that initially the said review of the hearing device parameter adjusted to the first criticality measure is carried out by means of the third criticality measure, and if the evaluation is positive, normal operation is simply continued, while in the event of a negative evaluation, further steps are proposed. However, the test mode may also take the form of an independent routine. In this case, the first use situation is established as part of the said routine, and the present setting of the hearing device is checked by means of the third criticality measure, which comprises adapting the at least one hearing device parameter based on the first criticality measure.

It further proves to be advantageous if when a second wearing situation is produced, the first wearing situation is produced for the second wearing situation, and in the second wearing situation, a fourth criticality measure is ascertained for the first use situation, the fourth criticality measure being used to specify a suitability of the second wearing situation for operating the hearing device. Preferably, the fourth criticality measure is determined as described above, i.e. in particular analogously to the first criticality measure and especially preferably, it is also ascertained for the third criticality measure; this ensures that the values of the first criticality measure and at least of the fourth criticality measure, and especially preferably also of the third criticality measure at a given frequency, are comparable. The creation of a second wearing situation may be particularly advantageous if the probability of feedback in the first use situation cannot be significantly reduced by adapting the hearing device parameters; this is determined in particular by checking the adaptation using the third criticality measure.

Thus, for example, a target may be established for changing the at least one hearing device parameter based on the first criticality measure, and this parameter may then be adapted accordingly under the constraints that result from the wearer's requirements for playback dynamics and playback volume. The first use situation is then created in test mode and the third criticality measure is ascertained for the adjusted settings. If it is now established that feedback is still critically probable even after the settings have been adapted, preferably within the audiologically acceptable range, this is interpreted as an indication of a broadly mechanical problem that may be remedied by changing the wearing situation.

Based on the fourth criticality measure, it is now checked in particular whether the settings already adapted in the first step—based on the first criticality measure—are suitable for regular operation of the hearing device in the second wearing situation, i.e. in particular whether the probability of feedback—according to the criticality measures used as criterion—is significantly reduced compared to the first wearing situation. Preferably, then, based on the fourth criticality measure, a target is established with respect to a suitability of the second wearing situation for operating the hearing device with the at least one hearing device parameter that has been adapted based on the first criticality measure.

Expediently, the second wearing situation is created by a position correction of an acoustic coupling piece of the hearing device, and/or a use of an acoustic coupling piece with changed dimensions, and/or a use of an acoustic coupling piece with a changed ventilation opening. "Acoustic coupling piece" here comprises in particular an earpiece, a "dome" and an "earmold." These actions are frequent sources of error when the hearing device is placed in its regular wearing position, but acoustic feedback may be corrected particularly efficiently by using another acoustic coupling piece in such a way that this piece may usually be replaced easily and without great expertise—i.e. also by the wearer himself or a trusted person, without having to visit a hearing device acoustician—and no further, more complex interventions on the hearing device are required. Against this background, the first wearing situation is created in particular by simply putting on the hearing device—according to the present mechanical configuration—in the intended wearing position.

It is advantageous that at least the first wearing situation and the first use situation are recorded by means of a video recording system. Such a video recording system may, in particular, make it possible to avoid the need to visit a specialist, e.g. a hearing device acoustician, in order to reduce the probability of feedback, which is convenient for the wearer.

It is also advantageous if image data that the video recording system generates is transmitted to and reproduced by a video playback system spatially separated from the wearer, and/or if an automatic command for determining the number of frequency-resolved curves of a feedback tendency of the hearing device in the first use situation is generated from the image data that the video recording system generates. The automatic command may be generated in particular by face recognition or image recognition in general, which determines that the first use situation has been correctly established, e.g. by detecting a jaw movement from chewing or speaking, or the wearer bringing mobile telephone to the ear.

For example, the video playback system may be arranged in a hearing device acoustician's workspace while the wearer is at home in the coverage area of the video recording system. On receipt of a start signal from the hearing device acoustician, at which point the feedback tendency is also to be determined, the wearer creates the first use situation in the first wearing situation, e.g. by putting on headgear or bringing a mobile telephone to the wearer's ear. The first use situation may now be terminated after a fixed time span, or it may be terminated if the curves ascertained for the feedback tendency no longer exceed their own extrema or envelopes for a certain measurement duration. The first criticality measure is now determined from the ascertained feedback tendency curves. An adaptation of at least one hearing device parameter is predetermined based on the first criticality measure. The adaptation itself may be done by the wearer himself, by a person the wearer trusts (particularly if the wearer is not able to do this alone), or by a suitable remote access by the hearing device acoustician.

After the adaptation has been completed, the first use situation may be restored in the test mode at a further start signal, and additional feedback tendency curves may be determined, from which the third criticality measure may then be ascertained. The third criticality measure is used to check whether the adjustment of the settings has sufficiently reduced the feedback tendency. If it has not, the hearing device acoustician may instruct the wearer to create the second wearing situation, and the specific steps to be taken may be selected based on the third and, if necessary, also based on the first criticality measure—for example, based on characteristic progressions of certain errors—and may in particular be specified automatically. If the specified second wearing situation involves an action that the wearer cannot carry out independently, a trusted person may carry out the second wearing situation via the video surveillance system under the instruction of the hearing device acoustician.

The first use situation is established in the above-described manner based on a start signal, and a new series of measurements of the feedback tendency is carried out to ascertain the fourth criticality measure, based on which the suitability of the second wearing situation for suppressing feedback is evaluated.

The invention also sets forth a hearing device that has been set up to carry out the above-described method. In particular, the hearing device contains means for detecting at least the attenuation of acoustic feedback from an output transducer of the hearing device to an input transducer. Preferably, the hearing device also has means for transmitting signal amplification and the attenuation caused by acoustic feedback to an external recording unit. In this case, parts of the procedure described above, such as ascertaining the first and subsequent criticality measures and the corresponding targets, may take place in the external recording unit. Alternatively, the hearing device preferably contains means for calculating the first and additional criticality measures.

In the following, an exemplary embodiment of the invention is explained in greater detail with reference to a drawing.

Other features which are considered as characteristic for the invention are set forth in the appended claims.

Although the invention is illustrated and described herein as embodied in a method for reducing the occurrence of acoustic feedback in a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Components and magnitudes that correspond to each other are respectively assigned the same reference signs in all drawings.

Figure 1:
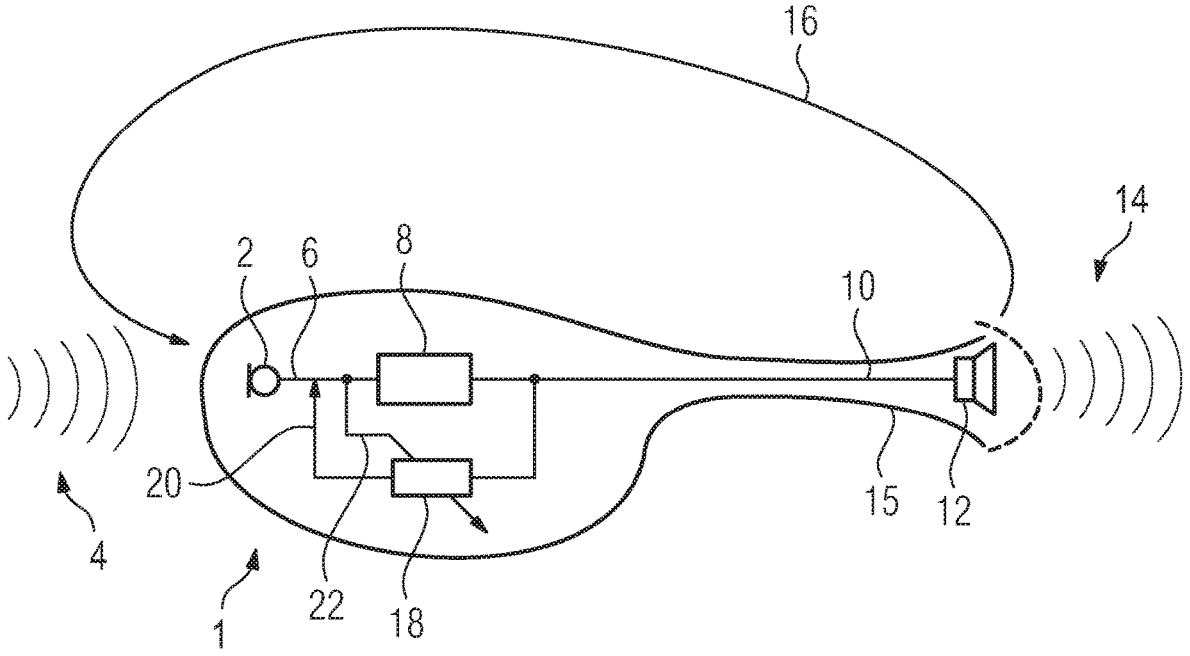
FIG. 1 is a block diagram of a hearing device in which acoustic feedback occurs.

Referring now to the figures of the drawings in detail and first, particularly to FIG. 1 thereof, there is shown a schematic block diagram of a hearing device 1. An input transducer 2 of the hearing device 1, here configured as a microphone, converts a sound signal 4 from the environment into an input signal 6. The input signal 6 is fed to signal processing 8 in the hearing device 1 and processed there according to the audiological requirements of the wearer of the hearing device 1, and is amplified in particular in a frequency-band-specific manner. An output transducer 12 of the hearing device 1 converts the output signal 10 that results from the signal processing 8 into an output sound signal 14 that is fed to the hearing system (not otherwise shown) of the wearer of the hearing device 1. The output transducer 14 in this case is provided as a loudspeaker that is arranged in an acoustic coupling piece 15 of the hearing device 1. The acoustic coupling piece in this case is provided as an earpiece. Along an acoustic feedback path 16, a part of the output sound signal 14 may now return to the input transducer 2, and thus find its way into the input signal 6, forming a closed feedback loop in which the signal processing 8 continuously amplifies signal components.

To suppress the acoustic feedback that occurs in this case, the gain may be reduced in the signal processing 8. However, such a reduction also entails a loss of gain for other signal components that acoustic feedback does not affect, so that the signal processing 8 no longer functions optimally according to the audiological requirements of the wearer of the hearing device 1. To ensure suppression of acoustic feedback even when these requirements are taken into account, the output signal 10 is often branched off and fed to an adaptive filter 18. Doing so generates a compensation signal 20 that is fed to the input signal 6 and subtracted from it. The signal that results from this subtraction is fed into both the signal processing 8 and the adaptive filter as an error signal 22. In the adaptive filter 18 in particular, the acoustic feedback path 16 and its frequency response are estimated.

However, in some situations, subtracting the compensation signal 20 from the input signal 6 may lead to undesired effects, for example artifacts in the output signal 10. The speed at which the feedback path estimate is updated determines a variable time parameter of the adaptive filter 18. The shorter this time parameter is set, the faster the feedback suppression adapts to a change in the acoustic feedback path. However, user may perceive the rapid readjustment as a disturbing artifact equally more frequently. In this respect, a trade-off must be chosen for a pleasant sound experience that is as free as possible from feedback.

Moreover, the occurrence of acoustic feedback sometimes also has predominantly mechanical causes, for example a non-optimal seating of the acoustic coupling piece 15 of the hearing device 1 in the wearer's ear such that a particularly high proportion of the output sound signal 14 escapes and may reach the input transducer 2 again. Other causes that are substantially mechanical may depend on a specific use situation such as chewing or speaking, or the influence of a mobile telephone or other similar object on the acoustic feedback path 16 near the hearing device 1. In this case, feedback suppression by the adaptive filter 18, with the associated risk of artifacts in the output signal 10, is not always effective. On the other hand, it may be useful or desirable to make the acoustic feedback that occurs as a function of the specific use situation more difficult from the outset, without significantly restricting the playback dynamics of the hearing device 1.

Figure 2:
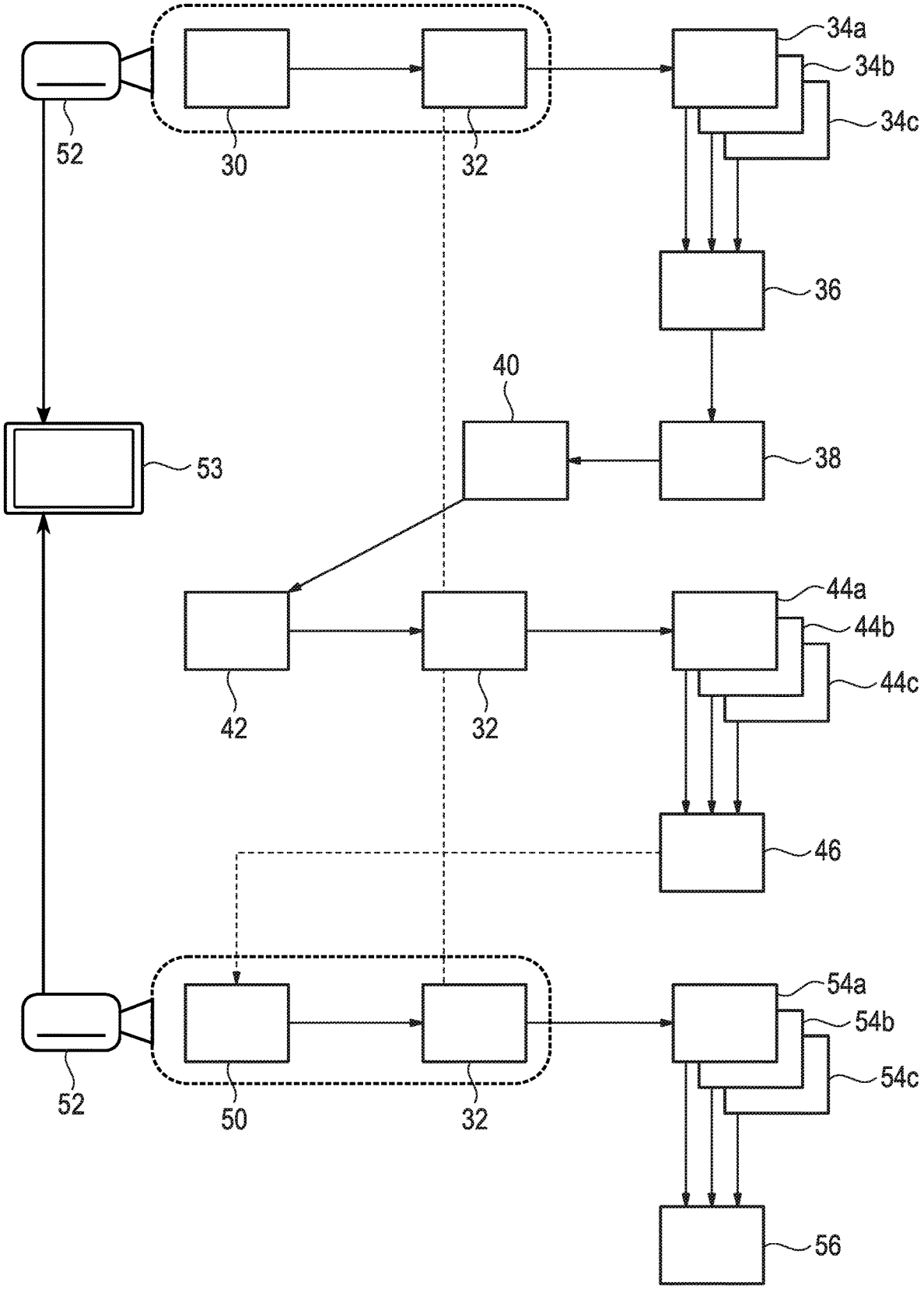
FIG. 2 is a block diagram of a method for reducing a feedback tendency in a hearing device as a function of a wearing situation and according to the invention.

This is shown in FIG. 2 in a block diagram which has a corresponding method as its subject matter. First, a first wearing situation 30 is created in which the wearer regularly fits the hearing device 1 according to FIG. 1. The first wearing situation 30 is characterized in particular by the global positioning of the hearing device 1 relative to the wearer, and also by the use of individual, reversibly exchangeable components such as an acoustic coupling piece 15 and their positioning relative to the wearer. In the first wearing situation 30, a first use situation 32 is now produced, which is characterized by at least one body movement of the wearer and/or an external object. This may be done, for example, by the wearer wearing headgear such as a hat or cap, making a jaw movement while speaking or chewing, or using a mobile telephone near the hearing device. During the first use situation, a plurality of frequency-resolved curves 34*a-c* of a feedback tendency of the hearing device are determined. This is done, for example, by repeating the measurement process for the feedback tendency by repeating the movement that corresponds to the first use situations, and generating a plurality of screenshots of the feedback tendency for the frequency over time. From the frequency-resolved curves 34*a-c* of the feedback tendency, a first criticality measure 36 is generated as described below, and based on this measure, a target 38 is established for adapting at least one hearing device parameter.

In an analogous manner not otherwise shown, a second use situation may also be created in the first wearing situation 30, and in this second situation, frequency-resolved curves of a feedback tendency of the hearing device 1 are likewise determined according to FIG. 1, and from these, a second criticality measure is ascertained. Based on the second criticality measure thus ascertained, a target may likewise be established for adapting one or more hearing device parameters, and the target may involve the hearing device parameter 40, for which a target 38 for adaptation has already been established based on the first criticality measure 36. The target established based on the second criticality measure may also affect other hearing device parameters for which no target yet exists.

The hearing device parameter 40 is now adjusted according to the target 38 and optionally according to another target that has been created in a second use situation. The hearing device parameter 40 may, for example, be a total gain at a specific frequency and/or a compression characteristic curve at a specific frequency, but it may also be a parameter of the adaptive filter 18 according to FIG. 1, for example a readjustment speed or a step size. Now a test mode 42 is started in which the hearing device 1 is tested in the first use situation 32. Here again, frequency-resolved curves 44*a-c* are ascertained for the feedback tendency of the hearing device. The frequency-resolved curves 44*a-c* are thus generated, while the motion corresponding to the first use situation is repeated in the test mode 42. A third criticality measure 46 is generated from the frequency-resolved curves 44*a-c* analogously to the first criticality measure 36. Based on the third criticality measure 46, it may now be determined whether adapting the hearing device parameter 40 according to the target 38 has significantly reduced the probability of acoustic feedback in the first use situation 32.

If it has not, a second wearing situation 50 is proposed. This wearing situation may be, for example, a correction of the position of the acoustic coupling piece 15 of the hearing device 1, or the use of an acoustic coupling piece with modified dimensions and/or modified ventilation openings. After the corresponding action has been proposed that characterizes the second wearing situation 50, which may occur in particular automatically, the wearer of hearing device 1 or a trusted person creates the second wearing situation. Next, the first use situation is created again for the second wearing situation 50 by the corresponding movement. Once again, frequency-resolved curves 54*a-c* for the feedback tendency are ascertained, and a fourth criticality measure 56 is determined on that basis. Using the fourth criticality measure 56, it may now be checked whether, according to the first criticality measure 36, the target established for the adapting of the hearing device parameter 40 in the second wearing situation 50 is suitable to keep the probability of acoustic feedback sufficiently low. If so, the second wearing situation 50 may be identified as the wearing situation to be used henceforth, for example by continuing to use a replaced acoustic coupling piece if appropriate, or by continuously ensuring that the acoustic coupling piece penetrates properly into the ear canal, if necessary, when applying the acoustic coupling piece. If the fourth criticality measure 56 does not suggest any significant improvement in the feedback tendency, then either a third wearing situation (not otherwise shown) may be created in a similar way to the second wearing situation 50, or the visit to a hearing device acoustician may be recommended as a "last resort" measure.

A video recording system 52 may generate image data for the first use situation 32 in the first wearing situation 30, and image data for the first use situation 32 in the second wearing situation 50. This image data may be transmitted to and reproduced by a video playback system 53, e.g., arranged in a hearing device acoustician's workspace while the wearer is at home in the coverage area of the video recording system 52.

Figure 3:
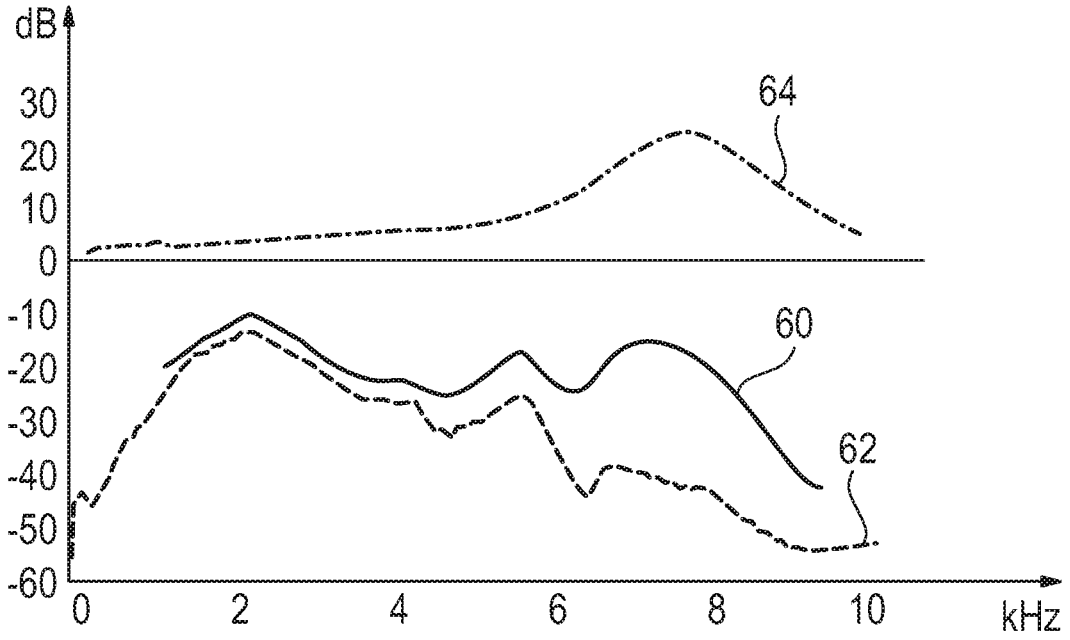
FIG. 3 is a graph diagram of a feedback tendency plotted against a frequency.

FIG. 3 shows a diagram with a feedback tendency 60 plotted in dB against the frequency f. The feedback tendency 60, which represents a probability of acoustic feedback occurring, is calculated in this case by adding the attenuation 62 of the acoustic feedback path 16 according to FIG. 1 (dashed line) to the gain 64 (dash-dotted line) that occurs in signal processing 8.

Figure 4:
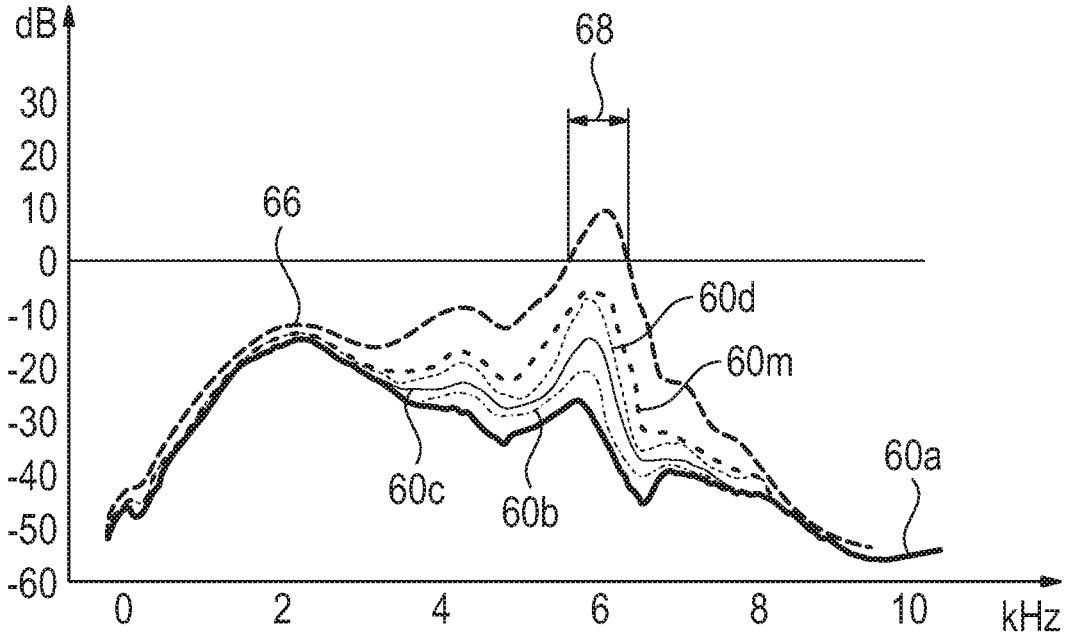
FIG. 4 is a graph diagram of a plurality of feedback tendencies for different use situations and a resulting criticality measure.

FIG. 4 shows a plurality of frequency-resolved curves 60*a-m* for the feedback tendency. These curves correspond, for example, to various individual measurements taken during the first use situation according to FIG. 2. In the frequency range up to approximately 3 kHz the individual curves 60*a-m* hardly differ from each other, and thus the variance of the different curve values at a given frequency is hardly worth mentioning, but from 3 kHz upwards the curves 60*a-m* drift noticeably apart. Particularly notably, in a narrow frequency range around 6 kHz, the individual curves differ by up to 30 dB. From 7 kHz upwards, the curves are almost uniform again.

Based on the curves 60*a-m*, a criticality measure 66 is ascertained analogously to the first criticality measure 36, third criticality measure 46 and fourth criticality measure 56. This is done by adding a correction term at each frequency f to the maximum value of 60*m* for the feedback tendency (dotted line), which monotonically depends on the variance of the individual values of the curves 60*a-m* at a given frequency f. Thus, for the high variance present just below 6 kHz, the criticality measure 66 (dashed line) is at a maximum.

The absolute values of the individual curves 60*a-m* in the range around 2 kHz are even higher than the maximum value 60*m* at approximately 4 kHz, but the criticality measure 66 nonetheless is greater than at 2 kHz due to the higher variance at 4 kHz. This takes account of the fact that over the entire range of possible values during the first use situation at 2 kHz, the stability of the system is higher than at 4 kHz, and as a result, it may be assumed that the ascertained maximum at 4 kHz does not necessarily correspond to the absolute possible maximum value, while the contrary is probably the case for 2 kHz due to the high stability at that frequency. Accordingly, the criticality measure is higher at 4 kHz.

From the criticality measure 66, frequency ranges 68 may now be identified for which acoustic feedback is particularly likely in the respective use situation, and which must accordingly be adapted to a hearing device parameter. To this end, the exceeding of a threshold value by the criticality measure 66 may be used as a criterion, and in a first approximation, 0 dB—i.e. the limit for a critical gain—may be selected as the threshold value.

Although the invention was illustrated and described in greater detail by means of the preferred exemplary embodiment, this exemplary embodiment does not limit the invention. A person of ordinary skill in the art will be able to derive other variations therefrom, without departing from the invention's protected scope.

The following is a summary list of reference numerals and the corresponding structure used in the above description of the invention:

1 Hearing device
2 Input transducer
4 Sound signal
6 Input signal
8 Signal processing
10 Output signal
12 Output transducer
14 Output sound signal
15 Acoustic coupling piece
16 Acoustic feedback path
18 Adaptive filter
20 Compensation signal
22 Error signal
30 First wearing situation
32 First use situation
34*a-c* Frequency-resolved curves
36 First criticality measure
38 Target
40 Hearing device parameters
42 Test mode
44*a-c* Frequency-resolved curves
46 Third criticality measure
50 Second wearing situation
54*a-c* Frequency-resolved curves
56 Fourth criticality measure
60 Feedback tendency
60*a-m* Frequency-resolved curves (for feedback tendency)
60*m* Maximum
62 Attenuation
64 Gain
66 Criticality measure
68 Frequency range

The invention claimed is:

1. A method for reducing an occurrence of acoustic feedback in a hearing device, which comprises the steps of:

creating a first wearing situation that determines a positioning of the hearing device relative to a wearer;

creating, for the first wearing situation, a first usage situation that is characterized by at least one body movement of the wearer of the hearing device and/or at least one relative position of an external object relative to the body of the wearer;

determining a plurality of frequency-resolved curves of a feedback tendency of the hearing device for the first use situation;

ascertaining a first criticality measure based on at least one of the frequency-resolved curves for the first use situation that contains information on a frequency range that is critical with respect to the occurrence of the acoustic feedback and a corresponding relative probability of acoustic feedback;

establishing at a given frequency, the first criticality measure for the first use situation at that frequency based on a dispersion measure for values of the feedback tendency that respectively result from the plurality of frequency-resolved curves;

establishing a second use situation for the first wearing situation;

ascertaining a second criticality measure for the second use situation, wherein the second criticality measure for the second use situation is ascertained in an analogous manner to the first criticality measure for the first use situation; and establishing a target for adapting at least one hearing device parameter and/or an additional hearing device parameter based on the first criticality measure and the second criticality measure.

2. The method according to claim 1, which further comprises:

measuring an attenuation of an acoustic feedback path; and determining the feedback tendency at a given frequency respectively by means of signal amplification in the hearing device and by means of the attenuation of the acoustic feedback path.

3. The method according to claim 1, which further comprises establishing the first use situation by at least one of:

the wearer putting on headgear;

the wearer moving a jaw;

the wearer using a mobile telephone near the hearing device;

the wearer engaging in a sporting activity; or the wearer being positioned in an immediate vicinity of a spatial boundary.

4. The method according to claim 1, which further comprises selecting the at least one hearing device parameter from the group consisting of:

a total gain at one frequency;

a compression characteristic curve at a frequency; and a readjustment speed.

5. The method according to claim 1, which further comprises:

adapting the at least one hearing device parameter in accordance with the target that was established based on the first criticality measure;

operating the hearing device with an adapted hearing device parameter in a test mode;

establishing the first use situation in the test mode; and ascertaining a third criticality measure for checking an adaptation for the first use situation in the test mode.

6. The method according to claim 1, which further comprises:

establishing a second wearing situation;

establishing the first use situation for the second wearing situation;

ascertaining a fourth criticality measure for the first use situation in the second wearing situation; and establishing the target with regard to a suitability of the second wearing situation for operating the hearing device based on the fourth criticality measure.

7. The method according to claim 6, wherein based on the fourth criticality measure, the target is established with respect to a suitability of the second wearing situation for operating the hearing device with the at least one hearing device parameter that has been adapted based on the first criticality measure.

8. The method according to claim 6, which further comprises establishing the second wearing situation by:

a position correction of an acoustic coupling piece of the hearing device; and/or use of the acoustic coupling piece with modified dimensions; and/or use of the acoustic coupling piece with a modified ventilation opening.

9. The method according to claim 1, which further comprises detecting at least the first wearing situation and the first use situation by means of a video recording system.

10. The method according to claim 9, which further comprises:

transmitting image data that the video recording system has generated to a video playback system spatially separated from the wearer, the video playback system reproducing the image data; and/or generating an automatic command for triggering a determination of a number of the frequency-resolved curves of the feedback tendency of the hearing device in the first use situation from the image data that the video recording system has generated.

11. A hearing device, comprising:

components for performing a method for reducing an occurrence of acoustic feedback in the hearing device, said components programmed to:

create a first wearing situation that determines a positioning of the hearing device relative to a wearer;

create, for the first wearing situation, a first usage situation that is characterized by at least one body movement of the wearer of the hearing device and/or at least one relative position of an external object relative to the body of the wearer;

determine a plurality of frequency-resolved curves of a feedback tendency of the hearing device for the first use situation;

ascertain a first criticality measure based on at least one of the frequency-resolved curves for the first use situation that contains information on a frequency range that is critical with respect to the occurrence of the acoustic feedback and a corresponding relative probability of acoustic feedback;

establishing at a given frequency, the first criticality measure for the first use situation at that frequency based on a dispersion measure for values of the feedback tendency that respectively result from the plurality of frequency-resolved curves;

establishing a second use situation for the first wearing situation;

ascertaining a second criticality measure for the second use situation, wherein the second criticality measure for the second use situation is ascertained in an analogous manner to the first criticality measure for the first use situation; and establishing a target for adapting at least one hearing device parameter and/or an additional hearing device parameter based on the first criticality measure and the second criticality measure.

* * * * *